US005163574A

United States Patent [19]

Sosan

[11] Patent Number: 5,163,574

[45] Date of Patent: Nov. 17, 1992

[54] PEDAL TRASH BIN

[76] Inventor: Folarin O. Sosan, 117 Varnum St. N.E., #6, Washington, D.C. 20011

[21] Appl. No.: 661,105

[22] Filed: Feb. 25, 1991

[51] Int. Cl.[5] ..... B65D 43/26

[52] U.S. Cl. ..... 220/264; 220/263; 220/262; 220/908; 220/254; 49/357; 49/379

[58] Field of Search ..... 220/264, 263, 262, 908, 220/326, 254; 49/379, 357, 347

[56] References Cited

U.S. PATENT DOCUMENTS

| | | | |
|---|---|---|---|
| 1,300,976 | 4/1919 | Jones | 220/264 |
| 1,481,685 | 1/1924 | Burrows | 220/264 X |
| 1,964,513 | 6/1934 | Hammer | 220/254 |
| 2,527,449 | 10/1950 | Poole et al. | 220/264 |
| 2,663,529 | 12/1953 | Lyttaker | 220/264 X |
| 4,729,490 | 3/1988 | Ziegenbein | 220/908 |
| 4,765,548 | 8/1988 | Sing | 220/908 X |
| 4,907,715 | 3/1990 | Bloomer | 220/263 |
| 4,913,308 | 4/1990 | Culbertson | 220/908 X |

*Primary Examiner*—Stephen Marcus

*Assistant Examiner*—Paul A. Schwarz

[57] ABSTRACT

A pedal trash receptacle intended for use in public places including restaurants, which allows two-handed handling of food trays. The trash receptacle utilizes a push-pull, or Bowden type cable connected between a foot pedal and a pivotally mounted door to cause opening of the door by actuation of the foot pedal. The trash receptacle comprises an upper portion which is hinged to a lower main portion so that the upper portion can be flipped open to permit insertion and removal of trash bags. When the top is closed the trash receptacle permits trash to be deposited through a door mounted and hinged in the upper portion of the trash receptacle. Stepping on the foot pedal causes the door to open inwardly permitting trash to be deposited inside the receptacle. When the foot pedal is released the door is closed by the action of springs. The trash receptacle also permits trash to be deposited by pushing the door open by hand. One embodiment of the trash receptacle utilizes a spring loaded push rod to close the door while another utilizes torsion springs.

17 Claims, 3 Drawing Sheets

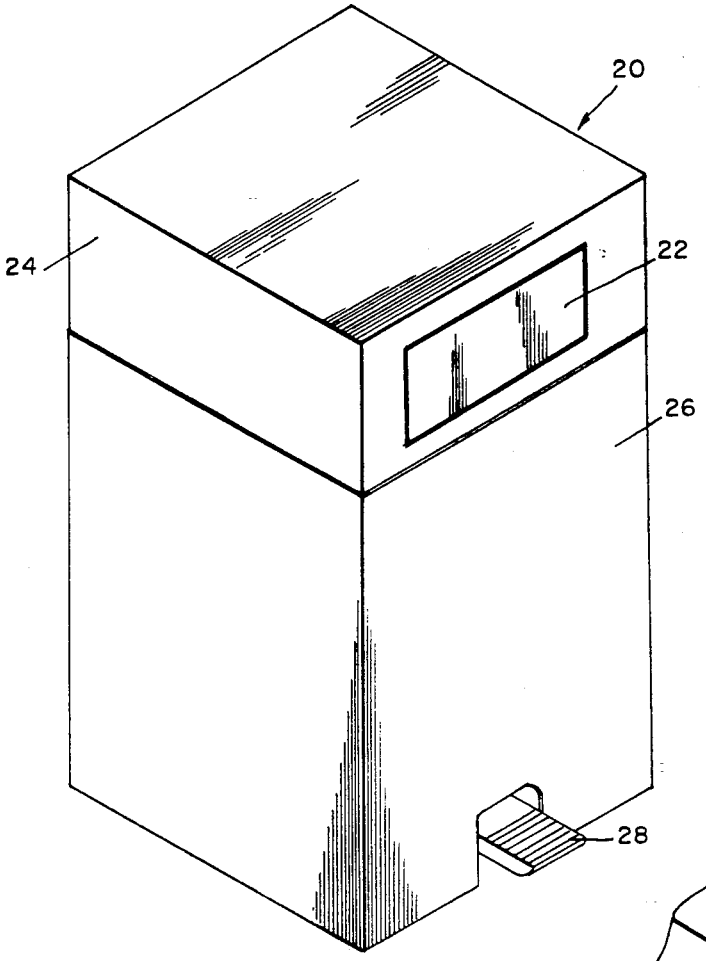
FIG. 1
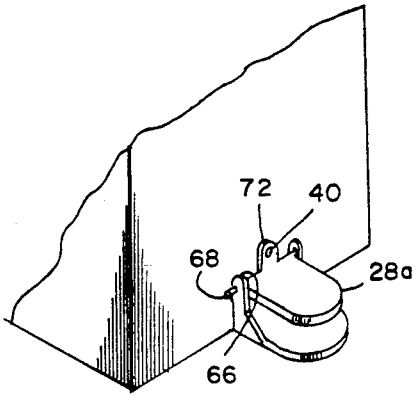
FIG. 10
FIG. 2
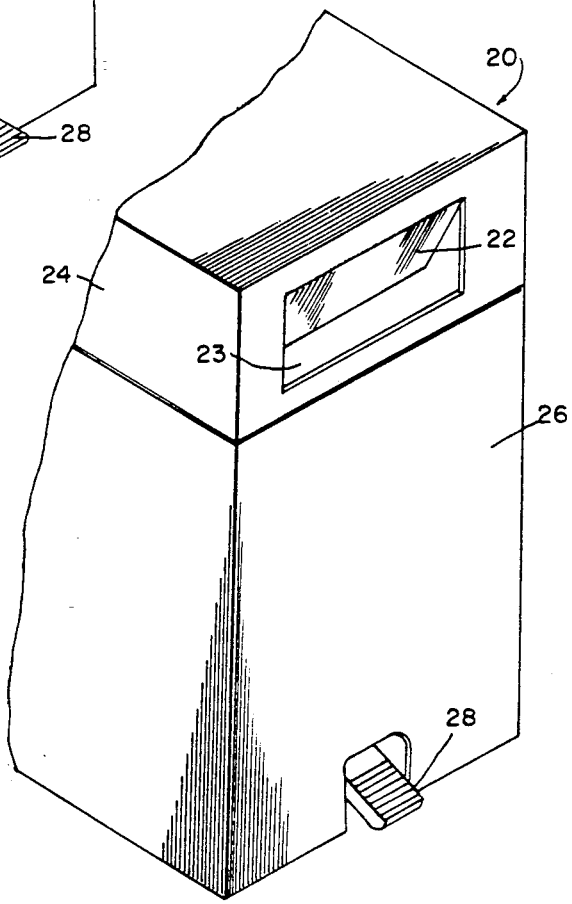
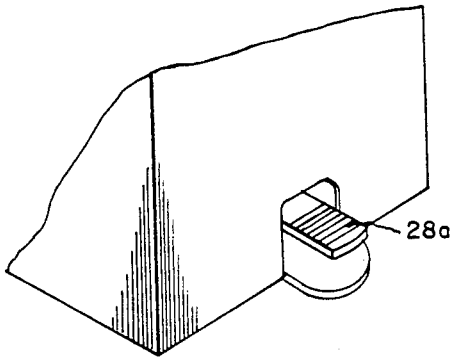
FIG. 11

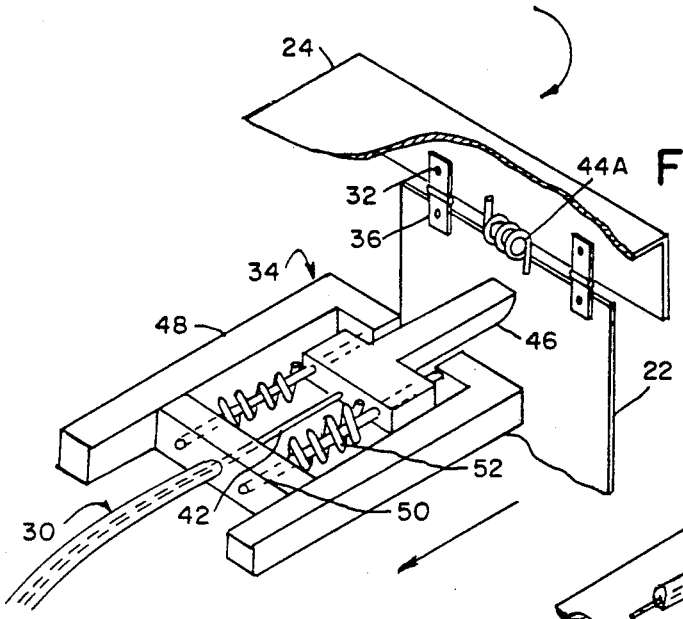
FIG. 5
FIG. 6
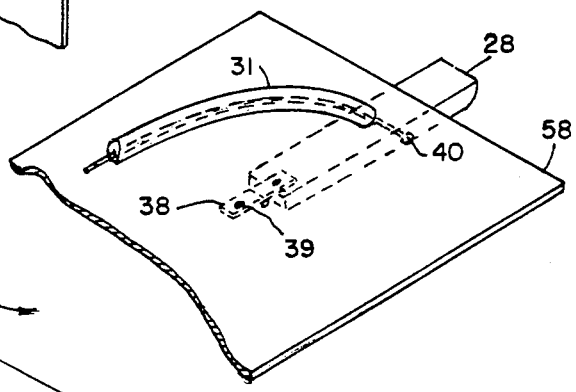
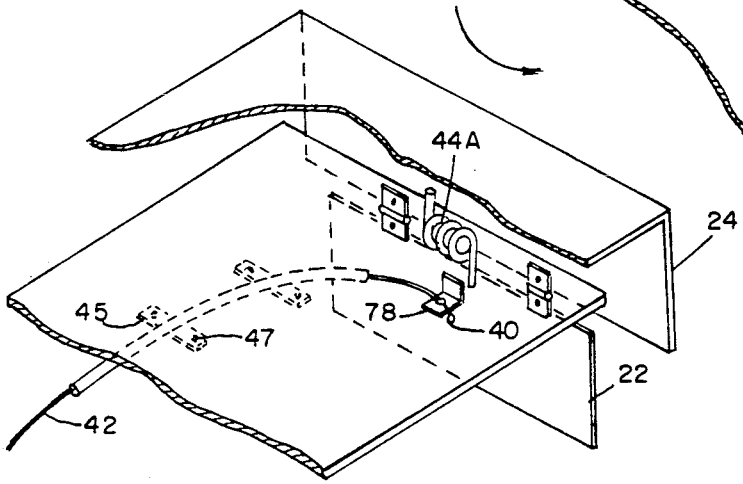
FIG. 7
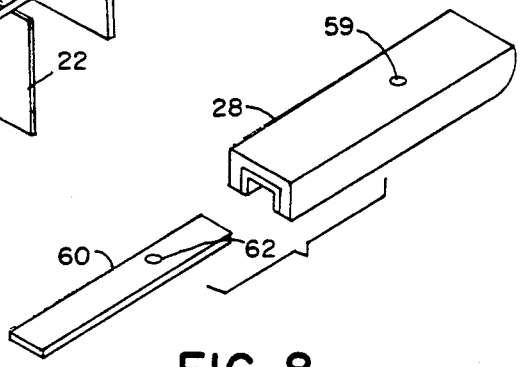
FIG. 8
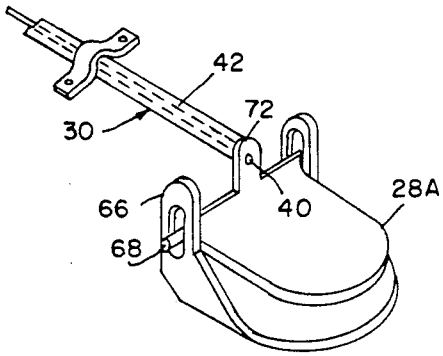
FIG. 9

PEDAL TRASH BIN

FIELD OF THE INVENTION

This invention relates to garbage receptacles, specifically to pedal operated garbage receptacles.

DESCRIPTION OF PRIOR ART

Trash bins in present use fall into two categories—open and closed. The open bins may be of the barrel type or rectangular. While offering the convenience of easy access, the open trash bins suffer the disadvantage of collecting rainwater and inviting flies, bees, and other insects leading to an unsanitary condition. The attraction they have for bees make them difficult to approach in summer months. This type of trash bin is generally not preferred in restaurants. The closed bin may be a barrel type with a removable cover, or it may have a hinged rectangular flap which may be spring loaded to close. The bins with a removable cover are not popular because they are inconvenient to use and people do not like to touch trash bins. The flap bins quickly become dirty and unsanitary as people use food and trash to push the flap open. People also wedge the flaps open with the trash in an attempt to avoid touching the bin which then suffers the disadvantages of the open trash bin. In many restaurants and cafeterias the flap bin is preferred. It however inconveniences patrons when they try to empty trays in the bin as they have to hold the flap bin open with one hand and hold a tray containing food, plates, cups, and cutlery with the other.

A pedal trash bin would be ideal in this case by allowing the user to open the bin with his foot while freeing both hands to sort and empty the tray into the bin. A typical pedal trash bin in present use has a hinged top which flips open when the pedal is depressed. The pedal actuates the top by means of rigid pivoted members which push the hinged top open. The problem most frequently associated with this kind of bin is failure of the linkage which is prone to break or jam. This approach has permeated virtually all of the prior art. U.S. Pat. No. 2,419,163 to Pope, discloses a pedal trash bin in which the pedal actuates a flip open lid by means of several rigid, jointed linkages. U.S. Pat. No. 2,533,524 to Snider, and U.S. Pat. No. 4,150,764 to Anderson, U.S. Pat. No. 4,081,105 to Dagonnet, and U.S. Pat. No. 4,765,548 to Sing, all disclose pedal trash bins in which the pedal actuates a flip open lid or a flap by means of rigid jointed linkages. U.S. Pat. No. 4,907,715 to Bloomer, shows a hand operated flap type trash bin which uses a flexible push pull cable as its main linkage. Being hand operated, this trash bin fails to solve the problem of the restaurant patron who still has to free one hand from his tray to operate the bin handle. This trash bin also lacks a self closing mechanism, requiring the user to close it after use, and will doubtless be left open often causing an unsanitary condition. Also as in the case of the flap type bin which has to be pushed open, the handle will get dirty with use and discourage people from using the bin.

Pedal trash bins which utilize rigid jointed linkages are notorious for their frailty and unreliability and none are offered for public use. The most common bin of this type is a small plastic bin with a flip open lid which is designed for the kitchen environment of a household, and even here the problems of its lid coming off, the linkage breaking or jamming are well known.

The approach most often used to mitigate rigid linkage failure in pedal trash bins has been to make the linkages even more rigid. Since a rigid linkage needs a rigid framework to support it, the trash bin also has to be made more rigid. This is usually done by making the bin out of a material which is stronger than plastic such as steel or aluminum. This conventional wisdom is aptly stated in U.S. Pat. No. 4,081,105, to Dagonnet which states "pedal bins in which the mechanical device is made entirely of plastics may on the other hand function with difficulty due to the parts controlling the opening of the lid being insufficiently rigid".

SUMMARY OF THE INVENTION

The improved pedal bin of the present design breaks with the conventional wisdom by taking the approach that the linkages in present use are too rigid and experience failure as a result. The improved pedal bin has a linkage which consists of a metal cable housed inside a tough plastic tube. The cable is usually made of steel and may be single or multi stranded. Such cables are known as push pull (or Bowden-type) cables and their proven reliability in several industries and in particular the automotive industry, where they are used for the remote opening of such things as hoods, gas cap doors, rear hatch doors, and in the operation of clutches, and gas pedals is well known.

Accordingly several objects and advantages of my invention are:

A pedal trash bin in which the linkage means that connects the pedal to the flip open lid or flap comprises a flexible push pull cable. This arrangement eliminates the need for jointed linkages for actuation around bends and corners of a trash bin. A push pull cable provides a continuous actuation means which curves around corners and bends without loss of function or decrease in performance. Such a linkage will not break or jam as is common with the rigid jointed linkages of present trash bins.

A pedal trash bin which employs springs acting in opposition to open or close the flap. Depressing the flap causes one set of springs to be overpowered allowing actuation of the flap under the action of the opposing set and closing achieved in the reverse manner. Such a mechanism is sturdy and since springs can be and are usually designed for "infinite life", can be made very reliable.

A pedal trash bin in which the pedal serves only to push or pull the cable and as such can eliminate the long pivoted pedal of most pedal trash bins. This will eliminate a source of breakage. The point of application of the load and the pivot point can be made to coincide if a pivoted pedal is used causing less strain on the pedal.

Several mechanisms may be used to translate the action of the push pull cable into opening of the flap, three embodiments of which are described herein.

A first embodiment of the mechanism uses opposing springs to open or close the flap.

In addition a second embodiment of the invention is detailed which incorporates a vertically aligned push rod. This embodiment allows the flap to swing through a large arc for only a small movement of the pedal. A third embodiment is proposed which comprises a simplified cable attachment.

Further objects and advantages of my invention will become apparent from a consideration of the drawings and ensuing description of it.

BRIEF DESCRIPTION OF THE DRAWINGS

FIG. 1 is a perspective view of a trash receptacle with a pivotally mounted door in the upper portion of the receptacle which is in a closed position.

FIG. 2 is a perspective view of a trash bin with a pivotally mounted door in the upper portion of the trash receptacle in an open position.

FIG. 5 is a perspective of a flap closing mechanism.

FIG. 6 is a perspective view of a pedal mechanism.

FIG. 7 is a perspective view of an alternate flap closing mechanism.

FIG. 8 is a perspective view of a pedal with a removable insert.

FIG. 9 is a perspective view of an alternate pedal mechanism.

FIG. 10 is a perspective view of a trash receptacle with a separately molded pedal.

FIG. 11 is a perspective view of a trash receptacle with a recessed, separately molded pedal.

DETAILED DESCRIPTION OF PREFERRED EMBODIMENTS

Figure 4:
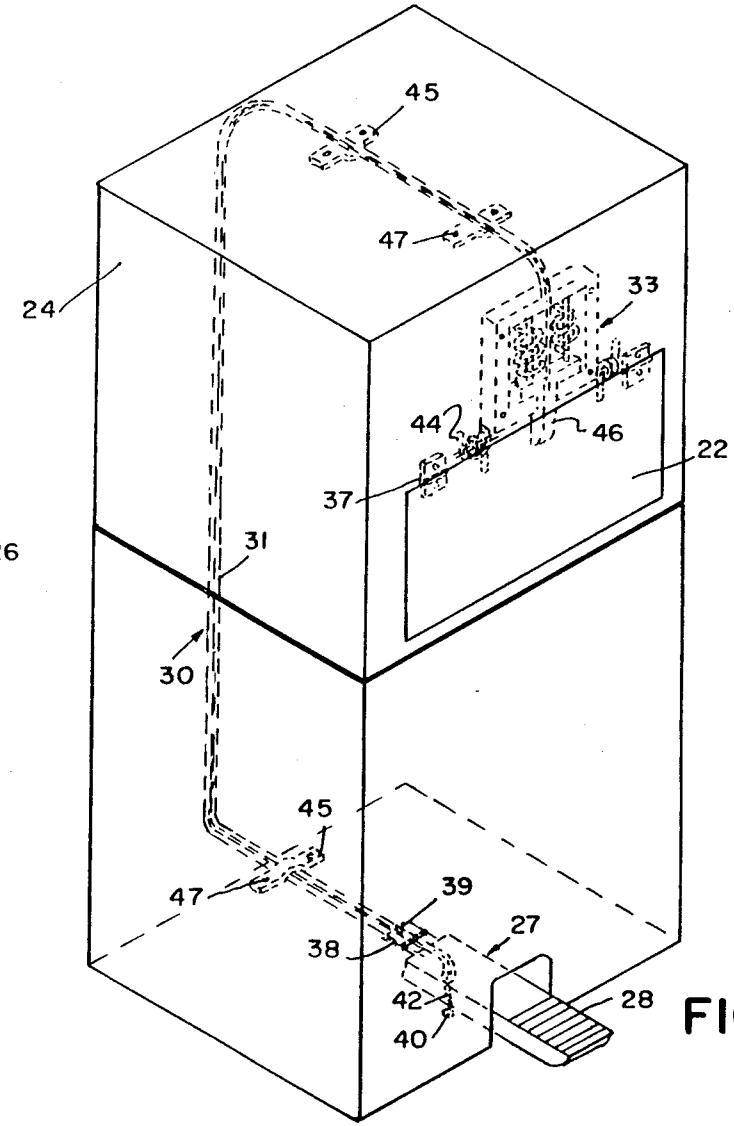
FIG. 4 is a perspective view of a trash receptacle with a vertically aligned push rod and flap mechanism.

FIGS. 1 and 2 show a trash receptacle 20 comprising an upper portion 24 and a lower portion 26. A door 22 is pivotally mounted adjacent to an opening 23 in the upper portion 24 of the trash receptacle. A pedal 28 is recessed at or near the bottom of the lower portion 26 of the trash receptacle, below the pivotally mounted door 22 and the upper portion 24 of the trash receptacle.

Figure 3:
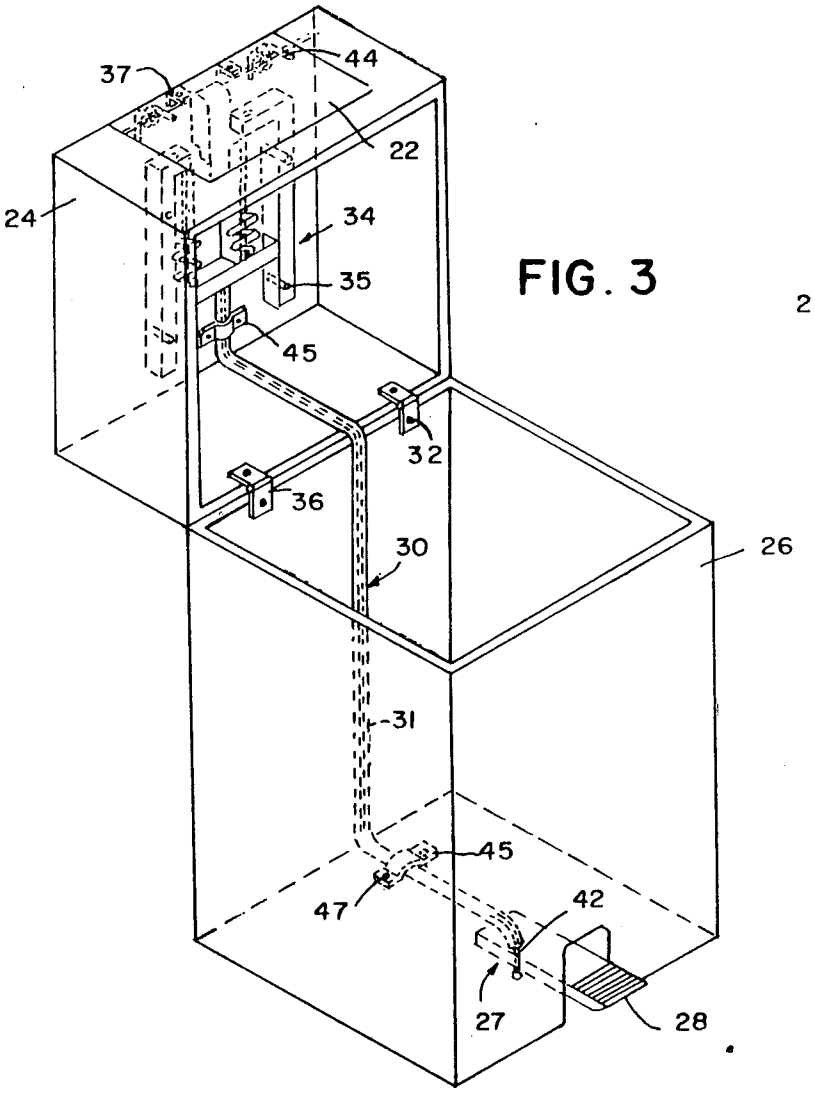
FIG. 3 is a perspective view of a trash receptacle with the upper hinged portion of its housing flipped open and at right angles to the rest of the housing.

As best shown in FIG. 3 the upper portion 24 of the trash receptacle is hinged to the lower portion 26 by means of hinges 36 and screws 32 so that it can swing open allowing access to the interior of the receptacle. The door 22, the upper portion 24, and the lower portion 26, as well as the foot pedal 28 are preferably made of plastic or rubber but can be made of wood or metal. A door closing mechanism 34 is shown attached to the underside of the trash receptacle top by means of screws 35. A flexible push pull cable 30 runs from the door closing mechanism to the pedal mechanism 27 at the base of the trash receptacle. The push pull cable comprises a plastic outer sheath 31 and an inner load bearing metal cable 42. The door 22 is attached to the upper portion 24 by means of hinges 37. A pair of torsion springs 44 attached to the door 22 and to the upper portion 24 on the inside of the bin, act to open the door 22. The spring loaded door closing mechanism 34 acts to close the door. Cable fasteners 45 attach the push-pull cable 30 to the body of the bin by means of screws 47. Depressing the pedal 28 causes the push-pull cable 30 to overcome the door closing mechanism 34 permitting the door 22 of the bin to be opened by the pair of torsion springs 44. When the pedal is released the door 22 closes again under the action of the door closing mechanism 34.

The horizontally aligned flap closing mechanism of FIG. 3 is shown in FIG. 5. It consists of the flap 22 which is connected to the upper portion 24 of the trash bin by means of hinges 36. The hinges 36 are fastened to the trash bin by means of screws 32. Also shown is a single torsional helical spring 44A which acts to pull the flap open inwardly against the resistance of the push rod 46. The guide rods 50 also pass through the base of the push rod 46. The push rod 46 thus travels along the two guide rods which are connected at both ends to the body 48 of the flap mechanism. The holes in the base of the push rod through which the guide rods pass are sufficiently large to allow free movement of the push rod. Compression springs 52 push the push rod 46 so that it rests against one end of the body 48 of the flap mechanism. The push pull cable is connected to the push rod by means of the inner cable 42 which passes through a hole in the base of the body 48 of the flap mechanism the hole being too small for the sheath 31 of the push pull cable, causing the sheath to rest against the body 48 of the mechanism. It thus serves as an anchor point from which the inner cable 42 of the push pull cable can pull the push rod along the guide rods. As shown therefore the push rod acts to close the flap 22 of the bin by pushing it shut, being in turn pushed by the compression helical springs 52 which at their other end, push against the base of the body 48 of the flap mechanism. This action of the push rod to close the flap is in opposition to the action of the torsion spring 44A which acts to pull the flap open inwardly. Because the compression springs 52 are stronger than the torsional spring 44A, the flap 22 is kept shut. When the pedal is depressed, the inner cable 42 of the push pull cable, pulls the push rod 46 back from the flap, thus overpowering the two compression springs 52 by the effort of the user. The overpowering of the two compression springs 52 thus allows the now unopposed torsion spring 44A to open the flap 22 inwardly. When the pedal is released, the push rod under the action of the compression springs, which reexert their dominance over the torsion spring, pushes the flap shut again. The inner cable 42 of the push pull cable is fastened to the base of the push rod by means of a cable stop such as is used to fasten the cable to the pedal, or in some other appropriate manner.

The pedal mechanism of FIGS. 1–3 is shown in FIG. 6. The push pull cable is fastened to the pedal 28 by means of its inner cable which passes through a small hole in the floor 58 of the trash bin. The hole being too big for the sheath 31 of the push pull cable, causes the cable sheath to rest against the floor of the trash bin. The cable continues through the floor of the bin and passes through a small hole in the pedal. The sheath 31 in its position against the floor of the bin serves as an anchor point from which the inner cable can be moved by the pedal without moving the sheath. The pedal is connected to the underside of the trash bin by means of hinges 38 and screws 39, the pedal and cable sheath being on opposite sides of the floor 58 of the bin.

FIG. 4 shows the trash bin with a vertically oriented flap closing mechanism 33. A push rod 46 is shown with a bevelled end which facilitates retraction of the push rod if the flap 22 is pushed in by hand. The hinges 37 which attach the flap 22 to the upper portion 24 of the trash receptacle are shown. The flap closing mechanism 33 is shown connected to the pedal mechanism 27 by the push pull cable shown in hidden detail. The pedal mechanism 27 comprises pedal 28, the inner metal cable 42 of the push pull cable 30, the outer sheath 31 of the push pull cable, a cable stop 40 at the end of cable 42, a hinge 38 which attaches the pedal 28 to the underside of the trash receptacle, and the screws 39 which fasten the pedal hinge 38 to the trash bin. Cable clamps 45 keep the cable sheath 31 fastened to the body of the trash receptacle by means of screws 47. One cable clamp is employed to hold the cable sheath 31 to the body of the trash receptacle near the pedal mechanism 27 and another is employed near the flap opening mechanism 33. The cable clamps prevent movement of the cable sheath 31 but allow movement of the inner metal cable 42. Torsion springs 44 act to pull the flap open inwardly. When the pedal 28 is stepped on, the cable stop 40 is pulled downward by the pedal causing the cable 42 to be pulled inside the cable sheath 31, the sheath being prevented from moving by the cable clamps. The sheath 31 ends on the inside floor of the trash receptacle while the cable 42 continues through a small hole in the pedal 28 to the cable stop 40 which is too big to pass through the hole in the pedal. As the cable 42 pulls back the push rod, the springs 44 pull the flap 22 inward causing it to open. The orientation of the push rod allows it to get completely out of the way of the flap 22 allowing it to open fully for just a small retraction of the push rod 46.

FIG. 7 shows an alternative flap closing mechanism. The flap closing mechanism is described as in FIG. 5, but the push rod, and the mechanism which operates it and which connects it to the flap are omitted. Cable clamps 45 are employed to fasten the cable sheath 31 immovably to the body of the trash receptacle by means of screws 47. Two such clamps are shown on the inside top portion 24 of the trash receptacle. The cable clamps permit movement of the inner cable 42 shown connected to the flap by means of an L shaped bracket 78 and the cable stop 40. The bracket can be made of metal, plastic, or wood and the inner cable passes through one segment of it through a hole which is too small for the cable stop to pass through. The torsion spring 44A acts outward to close the flap in this case. When the pedal is depressed, the push pull cable pulls the flap open inwardly in opposition to the torsion spring 44A which tries to shut it. When the pedal is released, the flap is shut under the action of the torsion spring 44A.

FIG. 8 shows a possible embodiment of the pedal which has a rectangular metal insert 60 which may be slid into the pedal to reinforce it. Holes 59 and 62 serve to allow the inner metal cable 42 of the push pull cable to pass through.

FIG. 9 shows a different pedal mechanism which may be made of metal. The pedal 28A is formed with and is integral with a rod 68 which passes through holes in the housing 66 of the pedal. The rod 68 has a protrusion 72 on its upper surface. The inner cable 42 passes through a small hole in the protrusion 72 which is too small for the cable sheath 30 to pass through, and at the other end of the protrusion 72 ends in a cable stop 40 which is too big to pass through the hole in the protrusion 72. When the pedal 28A is depressed, the rod 68 rotates downward, being constrained from other movement by the holes through which it passes. The protrusion 72 of the rod 68 traverses an arc, pulling the inner cable 42 but not the sheath 31 of the push pull cable. The actuation of the push pull cable by the pedal is thus accomplished.

FIG. 10 shows how a pedal mechanism of the type just described in FIG. 9 can be mounted externally and fastened to the body of the trash receptacle. The cable would be attached to the pedal as shown in FIG. 9 and would operate in the same manner. This embodiment shows how the manufacture of the bin can be simplified with the pedal being molded separately, and later fastened to the body of the trash bin, which could have been made separately from another material such as plastic.

FIG. 11 shows how a pedal mechanism of the type described in FIG. 9 can be fastened to the trash bin in such a way that the pedal housing and part of the pedal are recessed under the trash bin. The cable would be connected from the pedal to the flap opening mechanism of the trash receptacle. Such an embodiment would minimize the chances of people tripping over the pedal and would be aesthetically pleasing.

While the present invention has been described in certain particularity, it is not meant to be limited to the several disclosed embodiments. Therefore, the present invention will encompass the several disclosed embodiments and any modifications thereof which will fall within the scope of the appended claims.

I claim:

1. A trash receptacle comprising:

a lower body portion defining an interior space which is adapted to receive trash;

an upper body portion hinged to the lower body portion and movable between a first position wherein the upper body portion covers the lower body portion and a second position where the upper body portion is at least partially separated from the lower body portion so as to allow access to the interior space, the upper body portion further having an opening therein adapted to provide selective access to the interior space;

a door pivotally mounted on the upper body portion adjacent to the opening and pivotable between a closed position and an open position, wherein, in its closed position, the door is adapted to prevent access to the interior space through the opening, and, in its open position, the door is adapted to allow access to the interior space through the opening;

a foot pedal provided at a bottom portion of the lower body portion and adapted to be actuated by the user of the trash receptacle;

urging means for urging the door to its closed position; and overcoming means responsive to the actuation of the foot pedal for overcoming the urging means and permitting the door to move to its open position, wherein the overcoming means comprises a push-pull cable having a sheath surrounding an inner cable, wherein the sheath is secured to the trash receptacle, and wherein a first end of the inner cable is secured to a moveable portion of the foot pedal and a second end of the inner cable is disposed in a force transmitting relationship with the urging means and is operative when the foot pedal is actuated to overcome the urging means acting on the door, whereby when the foot pedal is actuated by the user of the trash receptacle, the inner cable of the overcoming means is displaced by the movement of the foot pedal and thus overcomes the urging means so as to permit the door to move to its open position, thereby allowing the user to deposit trash in the trash receptacle without touching the door.

2. A trash receptacle as recited in claim 1, wherein the urging means comprises a spring loaded push rod which urges the door to its closed position.

3. A trash receptacle as recited in claim 2, wherein the second end of the inner cable is secured to the spring loaded push rod, and the spring loaded push rod comprises a bevelled edge which urges against the door.

4. A trash receptacle as recited in claim 3, wherein the spring loaded push rod is vertically oriented and secured within the upper body portion.

5. A trash receptacle as recited in claim 3, wherein the spring loaded push rod is horizontally oriented and secured within the upper body portion.

6. A trash receptacle as recited in claim 1, wherein the urging means comprises a spring which resiliently urges the door to its closed position.

7. A trash bin as recited in claim 6, wherein the second end of the inner cable is secured to the door.

8. A trash receptacle as recited in claim 1, wherein the foot pedal is pivotally connected to an underside of a floor of the lower body portion.

9. A trash receptacle as recited in claim 1, wherein the foot pedal is mounted externally to the bottom portion of the trash receptacle.

10. A trash receptacle as recited in claim 6, wherein the spring is a torsion spring.

11. A trash receptacle as recited in claim 1, wherein the sheath of the overcoming means is secured to the upper body portion and the lower body portion of the trash receptacle by means of clamps.

12. A trash receptacle as recited in claim 1, wherein the sheath is secured to an inside floor of the lower body of the trash receptacle.

13. A trash receptacle as recited in claim 1, wherein the inner cable extends from the foot pedal, into the lower body portion, and to the upper body portion of the trash receptacle.

14. A trash receptacle as recited in claim 13, wherein the second end of the inner cable is connected to the door.

15. A trash receptacle as recited in claim 14, wherein the second end of the inner cable is connected to the door by means of a bracket.

16. A trash receptacle as in claim 2 wherein a spring in combination with the push rod, acting oppositely to said push rod urges the door to its open position.

17. A trash receptacle as recited in claim 1, wherein the door is generally vertical.

* * * * *